United States Patent [19]

Stange

[11] 4,003,233

[45] Jan. 18, 1977

[54] BENDING AND STRAIGHTENING MECHANISM FOR MINE ROOF BOLTS

[75] Inventor: Ronald R. Stange, Denver, Colo.

[73] Assignee: Tools for Bending, Inc., Denver, Colo.

[22] Filed: Apr. 7, 1975

[21] Appl. No.: 565,421

[52] U.S. Cl. ..... 72/133; 72/149;152;155;159

[51] Int. Cl.[2] ..... B21D 7/04

[58] Field of Search ..... 61/45 B; 72/133, 149, 72/155, 156, 159–161, 309, 310, 319, 321, 388, 152, 157, 158; 173/38, 43, 52; 175/103; 166/75, 77

[56] References Cited

UNITED STATES PATENTS

| | | | |
|---|---|---|---|
| 2,548,616 | 4/1951 | Priestman et al. | 175/103 |
| 3,116,781 | 1/1964 | Rugeley et al. | 175/103 X |

FOREIGN PATENTS OR APPLICATIONS

| | | | |
|---|---|---|---|
| 447,841 | 1/1913 | France | 72/149 |
| 844,850 | 7/1952 | Germany | 72/155 |
| 627,701 | 11/1961 | Italy | 72/159 |
| 525,895 | 9/1940 | United Kingdom | 72/157 |
| 736,665 | 9/1955 | United Kingdom | 72/149 |
| 880,691 | 10/1961 | United Kingdom | 72/158 |

*Primary Examiner*—C.W. Lanham
*Assistant Examiner*—E. M. Combs
*Attorney, Agent, or Firm*—John E. Reilly

[57] ABSTRACT

A method and apparatus for successively bending and straightening a bolt shank and the like for insertion into a bolt hole is characterized by a readily transportable compact device having inner and outer spaced cooperating rollers engageable with diametrically opposed surfaces of the shank so that when the cooperating rollers are simultaneously rotated along a predetermined bending path the shank will be bent through a corresponding curvature and in a direction aligned with a bolt hole into which the shank is to be inserted. A straightener roll is disposed in the path of the shank as it becomes aligned with the bolt hole to straighten the shank prior to advancement into the hole. In the method of successively bending and straightening a bolt shank in accordance with the present invention, the shank is positioned at a substantial angle of 90° to the longitudinal axis of the bolt hole, the leading end of the shank is bent in a direction towards the entrance of the hole until it becomes axially aligned with the hole, and the shank is progressively bent along its length in a direction towards the hole followed by progressively straightening of the shank as it advances into axial alignment with the hole while continuously feeding the entire length of the shank into the bolt hole.

17 Claims, 10 Drawing Figures

BENDING AND STRAIGHTENING MECHANISM FOR MINE ROOF BOLTS

The present invention relates to a method and apparatus for successively bending and straightening bolt shanks, elongated rods, shafts and the like; and more particularly relates to a novel and improved method and apparatus for bending and straightening elongated bolt members for insertion into a bolt hole formed in a mine roof or wall.

BACKGROUND OF THE INVENTION

In shoring up mine roofs or walls or other restricted areas, elongated mine roof bolts are customarily employed. In the past, limitations have been placed upon the length of the bolt owing to the limited opening size of the mine tunnel and has presented definite hazards from the standpoint of mine safety. Accordingly there has been a long-standing need for a method and means for inserting bolts which may be of a length substantially greater than the size or diameter of the mine tunnel or opening so as to assure insertion of the bolt to the depth necessary to be positively anchored in place. It is therefore highly desirable that a portable device be provided which is capable of semi-automatic operation within a restricted area to rapidly and dependably insert a bolt of the desired length and diameter into a bolt hole and specifically in such a way that the bolt shank can be successively bent from a direction of substantially 90° to the hole into axial alignment with the hole followed by progressive straightening of the shank until it is fully inserted into the bolt hole, and to do so without weakening or damaging the bolt.

SUMMARY OF THE INVENTION

Accordingly, it is an object of the present invention to provide for a novel and improved method and apparatus for successively bending and straightening bolt shanks, elongated shafts or rods and the like.

It is another object of the present invention to provide apparatus capable of manipulating relatively long mine roof bolts for insertion into bolt holes in mine roofs or walls and other restricted areas where there is otherwise insufficient space to permit the bolt to be aligned with the bolt hole and inserted directly into position.

It is an additional object of the present invention to provide for a mine roof bolt bending and straightening apparatus which is readily transportable into alignment with a bolt hole and can be motor driven to successively bend the shank of the bolt to the extent necessary to start the bolt into the hole followed by progressively straightening the bolt after bending for full and complete extension into the hole.

It is an additional object of the present invention to provide a novel and improved method and means for inserting mine roof bolts into bolt holes in which each bolt can be automatically gripped, bent and straightened for insertion into a hole without damaging the bolt or its anchoring elements.

In accordance with the present invention it has been found that bolts of the desired length can be rapidly inserted or placed on a bolt hole, notwithstanding restrictions in the working space surrounding the hole which would preclude direct lengthwise or axial insertion in the following manner: positioning the bolt substantially at an angle of 90° to the longitudinal axis of the bolt hole, bending the leading end of the bolt in a direction towards the bolt hole until the leading end is axially aligned with the axis of hole so that the leading end can be inserted lengthwise into a hole, and progressively bending the shank along its length while advancing it in a direction towards the bolt hole followed by progressive straightening of the shank as it approaches the entrance to the bolt hole so as to permit it to be fed continuously into the hole. In carrying out the method of the present invention, the preferred form of bolt bending and straightening apparatus includes a drive roll which has an outer, grooved peripheral surface together with drive means for rotating the drive roll. A bend arm roller unit is mounted for rotation about an axis located eccentrically with respect to the axis of rotation of the drive roll, and a pinch roller on the bend arm roller unit is disposed radially outwardly of the grooved peripheral surface of the drive roll which cooperates with the drive roll in gripping diametrically opposed surface portions of the bolt shank. The bend arm roller unit is driven in such a way as to cause the pinch roll to rotate with the drive roll while gripping the bolt shank therebetween so as to bend the shank along a predetermined radius of curvature. At the end of its travel, the bend arm roller unit includes an additional roller which cooperates with a straightening roller at a point adjacent to the bolt hole to cause straightening of the bolt shank for entrance and progressive insertion into the hole. The apparatus of the present invention is capable of bending different diameters and lengths of bolt shanks, within limits, and can be readily transported and moved into alignment with each bolt hole for insertion of the bolt therein.

BRIEF DESCRIPTION OF THE DRAWINGS

Other objects, advantages and capabilities of the present invention will become more apparent as the description proceeds taken in conjunction with the accompanying drawings, in which.

DESCRIPTION OF THE PREFERRED EMBODIMENT

Figure 2:
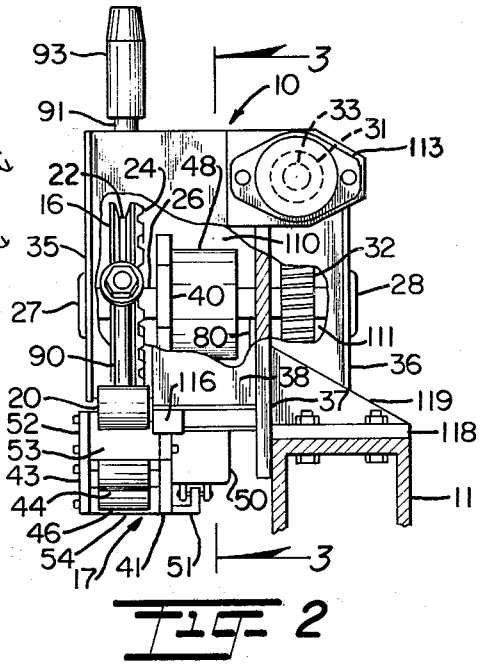
FIG. 2 is a side elevational view of the bolt bender with a portion of the housing being cut away to show the internal drive mechanism.
Figure 1:
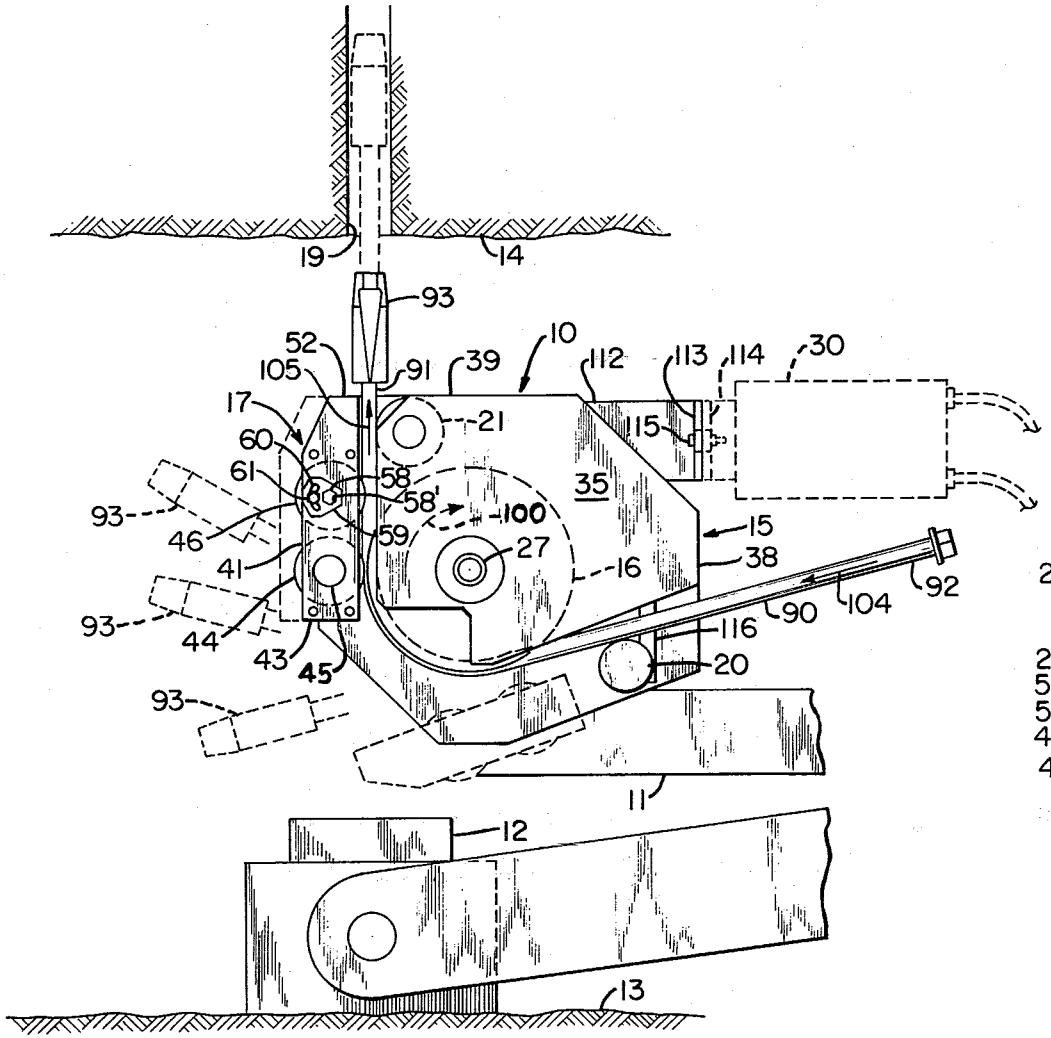
FIG. 1 is a front elevational view of the bolt bending device in position for inserting a bolt into an opening in a mine tunnel showing successive positions of the leading end of the bolt shank as the initial bend is made.

A bolt bending device 10 constructed in accordance with the present invention is shown in FIGS. 1 and 2 mounted on a boom arm 11 of a typical portable roof bolter machiner which does not constitute any part of the present invention, with the drill head 12 of a typical machine resting on the mine floor 13 to secure the apparatus in place. Of course, the belt bending device 10 can be positioned in place by any other convenient manner appropriate for its use.

Figure 9:
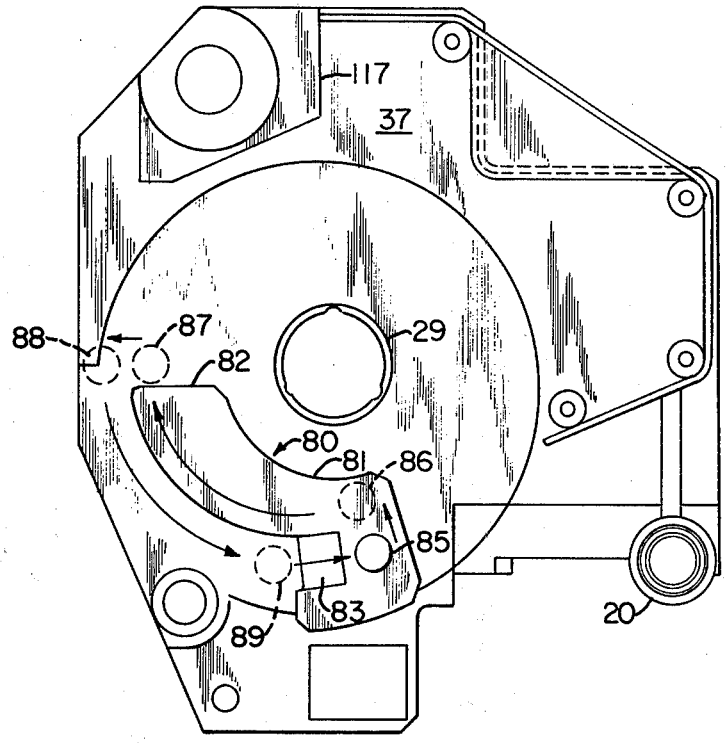
FIG. 9 is a front elevation view of the housing with the front plate and operational components removed to show the position of the program control plate and with successive positions of the shuttle pin being shown on the program control plate.

The bolt bender 10 includes a housing 15 which functions as the main structural framework in which the primary components of the device are mounted. The major components include a drill roll 16, bend arm assembly 17, eccentric control assembly 18 as shown in FIGS. 3–6, a program control plate 80 as shown in FIGS. 7 and 9, a reaction roller 20, and a straightener roller 21.

Referring to FIGS. 3 to 6, the drive roll 16 functions as the master drive means for the remaining components of the bolt bender 10. It is formed of a wheel with an outer, grooved peripheral surface 22 about its circumference and with a ring of radially directed teeth 24 at equally spaced circumferential intervals defined on one side surface. The drive roll 16 is mounted on a drive shaft 26 and is keyed therewith for direct rotational drive and torque transfer. The drive shaft 26 is journaled at one end in appropriate bearings 27 mounted in the front plate 35 of housing 15, at the opposite end in appropriate bearings 28 mounted in the gear covering 36 of housing 15, and along its midspan in an appropriate bearing not shown mounted in the main plate 37 of housing 15.

The prime mover is a hydraulic motor 30, shown in phantom lines in FIG. 1, or any other appropriately powered motor, with a worm gear 31 shown in phantom lines in FIG. 2 mounted on its power output shaft 33. The motor 30 is removably secured to the housing 15 by mating flanges 113 and 114 and bolts 115. The worm gear 31 engages the worm wheel 32 which is in turn mounted on drive shaft 26 and keyed thereto for rotational drive and torque transfer in a conventional manner.

Figure 7:
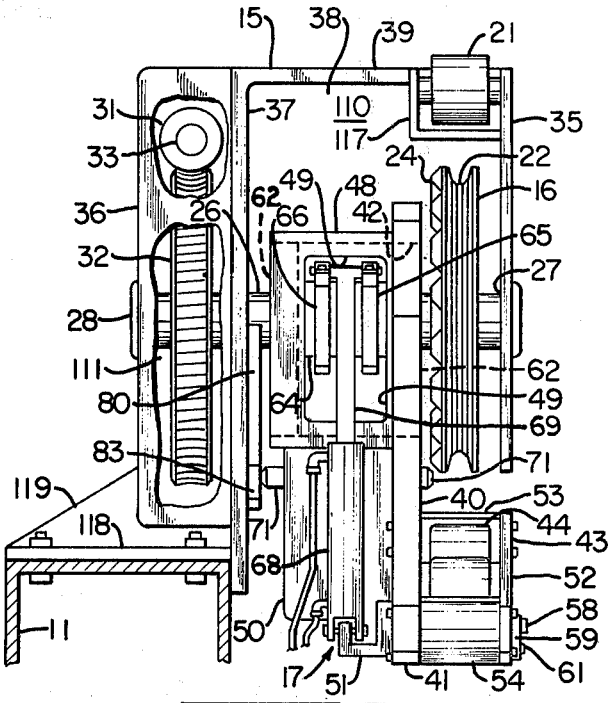
FIG. 7 is a side elevation view showing the internal drive mechanism from the side opposite that shown in FIG. 2, the eccentric wheels within the bend assembly being shown in phantom lines and with a portion of the housing being cut away to illustrate the drive gear assembly.

As seen from FIG. 7, the bend arm assembly 17 includes a generally L-shaped bend arm 40 which is journaled for free rotation about the outer periphery of an eccentric wheel 62. A pair of rollers are mounted in the foot portion 41 of the bend arm 40, one of said rollrs being a pinch roller 44 and the other being a bend roller 46, and a disengageable follower mechanism 70 serves to transmit rotational movement from the drive roll 16 to the bend arm 40. When the follower mechanism 70 is engaged with drive roll 16, the bend arm 40 is caused to rotate about a central axis defined by the drive shaft 26, the foot portion 41 thereby describing an arc a fixed radial distance from the central axis.

The eccentric control assembly 18 comprises the eccentric wheel 62 which is eccentrically mounted on a tubular shaft 64, the shaft 64 being journaled for free rotation about the main shaft 26. A pair of lever plates 65 and 66 are rigidly attached to the tubular cross-shaft 64 in spaced relation to each other within the hollow center of the eccentric wheel 62, and a hydraulically activated cylinder 68 is pivotally and releasably attached between the lever plates 65 and 66 and the foot portion 41 of the bend arm 40.

Figure 5:
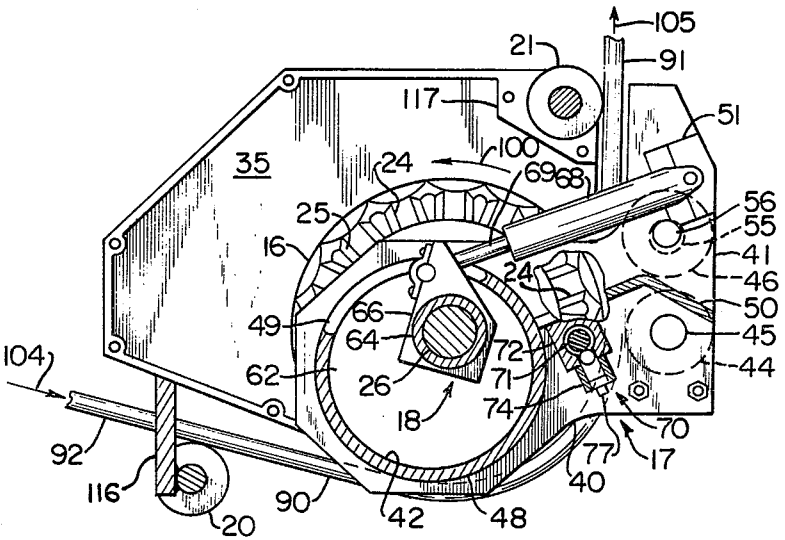
FIG. 5 is a similar view showing the clamp and swing arm assembly in the full operational bending position with the assembly still clamped on the bolt shank but disengaged from the drive wheel.
Figure 6:
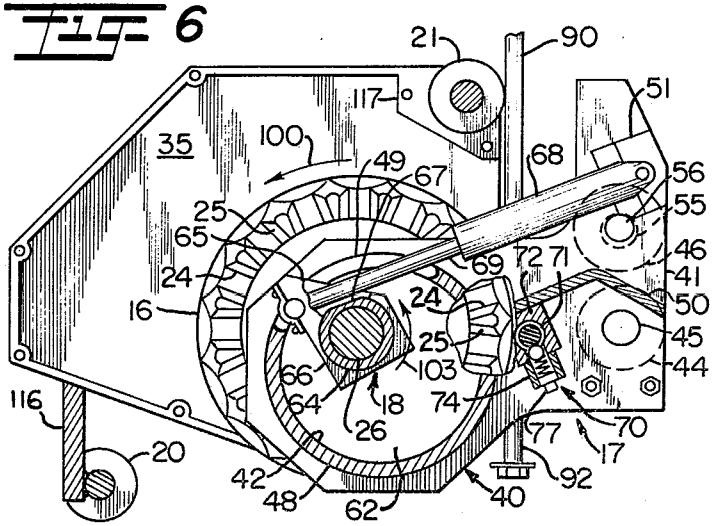
FIG. 6 is a similar view showing the clamp and bend arm assembly in its final released position just before it swings back to the starting position.
Figure 3:
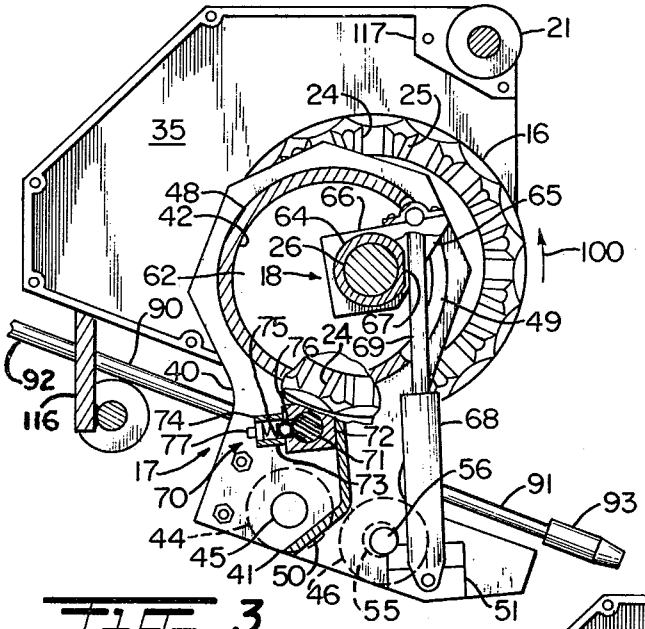
FIG. 3 is a transverse cross-sectional view taken approximately on the section 3—3 of FIG. 2 showing the clamp and bend arm assembly in starting position, portions of the clamp and bend arm assembly being cut away to illustrate the relation of the bend arm assembly and drive mechanism with the drive wheel and to reveal the detent retainer mechanism and the interrelation of components of the eccentric control mechanism.
Figure 4:
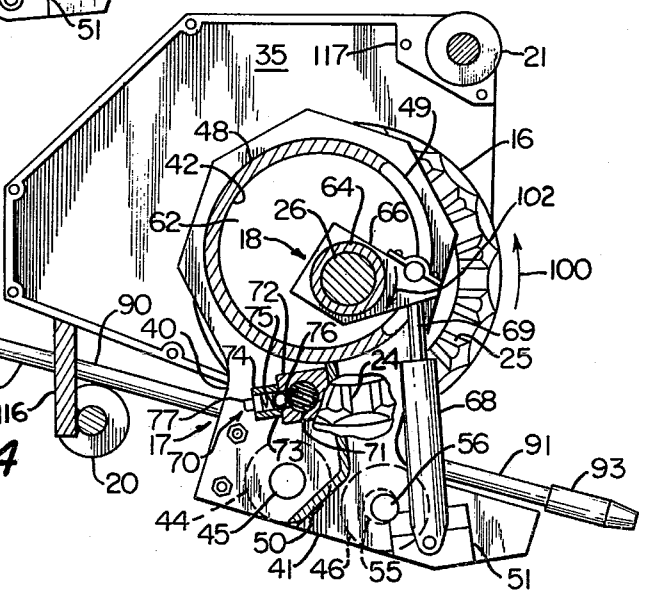
FIG. 4 is a similar view showing the clamp and bend arm assembly in initial clamping position, the assembly being engaged with the drive wheel.

As will be described in more detail hereinafter the above-described components interact to drive a relatively long shank or workpiece 90 through a successive bending and restraightening manipulation as follows: The workpiece 90 is placed on the reaction roller 20 as seen in FIGS. 1 and 3; the hydraulic motor 30 is energized to impart rotational movement to the drive roll 16 in the direction indicated by the arrow 100; the hydraulic cylinder 68 is actuated to retract the ram 69 into the cylinder 68 thereby pulling the lever plates 65 and 66 toward the cylinder 68 and causing the shaft 64 and eccentric wheel 62 to rotate about the axis defined by drive shaft 26 in the direction indicated by the arrow 102, see FIG. 4. Such rotation of the eccentric wheel 62 causes the larger portion of the eccentric wheel 62 to move upwardly in relation to the drive shaft 26 thereby also causing the bend arm assembly 17 to move upwardly toward the drive roll 16. As the bend arm assembly 17 moves toward the drive roll 16, it urges the workpiece 90 into position against the grooved surface 22 of the drive roll 16, and by maintaining the hydraulic pressure in the cylinder 68, the continuing force in the bend arm assembly 17 will clamp the workpiece between the pinch roller 44 and the drive roll 16. The upward movement of the bend arm assembly 17 also moves the bend arm follower mechanism 70 into engagement with the teeth 24 on drive roll 16 whereby the drive roll 16 imparts rotational movement to the bend arm 40. As the drive roll 16 carries the bend arm assembly 17 for rotation about the drive shaft 26 in the direction indicated by arrow 100 the workpiece 90 remains tightly clamped between the pinch roller 44 and the grooved surface 22 of the drive roll 16 and with the forward portion 91 of workpiece 90 in contact with bend roller 46 and with the rearward portion 92 of workpiece 90 in contact with reaction roller 20 the workpiece 90 is bent around a portion of the circumference of the drive roll 16. As will be described in more detail hereinafter, the program control plate 80 retains the bend arm drive mechanism 70 in engagement with the teeth 24 on the drive roll 16 through an interval of approximately 90°, after which the program control plate 80 allows the drive mechanism 70 to be released from the teeth 24. Upon disengagement the bend arm assembly 17 cases rotation, but the force clamping the workpiece 90 between the pinch roller 44 and the drive roll 16 is maintained so that the continuing rotation of the drive roll 16 drives the workpiece 90 through the bolt bender 10 in a direction indicated by the arrows 104 and 105. The degree of bend of workpiece 90 is limited by contact of the forward end 91 with the straightener roller 21. As the workpiece continues its travel through the bolt bender 10 as shown in FIG. 5 diametrically opposed forces exerted on the workpiece 90 by the bend roller 46 and the straightener roller 21 respectively causes the workpiece 90 to be re-straightened for insertion into the hole in the rock of the mine wall in a direction of travel 105 substantially perpendicular to the beginning direction of travel 104. After the desired length of workpiece 90 is driven through the bolt bender 10 the ram 69 of cylinder 68 is hydraulically extended causing the shaft 64 and the eccentric wheel 62 to rotate in the opposite direction about the axis defined by drive shaft 26, as indicated by arrow 103, thereby moving the bend arm assembly 17 radially outward from drive shaft 26 and releasing the clamping force of pinch roller 44 on the workpiece 90, as seen in FIG. 6. As the bend arm 40 is moved radially outward from the drive shaft 26, the program control plate 80 allows the bend arm assembly 17 to leave its point of maximum rotation and swing back down by force of gravity to its starting position as shown in FIG. 3.

The housing 15 comprises two compartments: The main compartment 110, defined by the front plate 35, main plate 37, side plate 38, and top plate 39, houses the primary operating mechanisms including the drive roll 16, the bend arm assembly 17, the eccentric control assembly 18, and the program control plate 80. The secondary compartment 111 houses the drive gears including the worm gear 31 and worm wheel 32 and is defined by the main plate 37 and gear covering 36. An extension 112 of gear covering 36 provides a flange 113 which mates with a corresponding flange 114 on motor 30 for mounting motor 30 on the bolt bender 10. The motor 30 is secured in place by flange bolts 115. The housing 15 also includes a structural member 116 and a frame 117 on which the respective shafts for reaction roller 20 and straightener roller 21 are mounted. A mounting plate 118 with cross-brace 119 are shown attached to main plate 36 for rigidly mounting the bolt bender 10 to the tool boom 11 of a roof bolter machine; however, it is well recognized that other types and methods of mounting can be employed, such as providing means to allow the bolt bender 10 to be freely turned, moved and aligned by mounting on pivot pins, hinged arms, and the like.

The bend arm 40 is formed of a strong steel plate with an L- or foot-shaped portion 41 at its lower extremity and an enlarged area with a large hole 42 centrally located at its upper extremity. A tubular sleeve 48 with an inner bore equal to the diameter of hole 42 is rigidly attached to one side of the bend arm 40 in alignment with hole 42, as shown in FIGS. 2–7. The tubular sleeve 48 has an opening 49 in its side appropriately oriented to allow for movement of components of the eccentric control assembly 18. A web brace 50 is rigidly attached to the lower side of the tubular sleeve and to the side of the bend arm 40 to strengthen the bend arm assembly 17 and to aid in transferring forces from the outer end of tubular sleeve 48 to the bend arm 40. A mounting bracket 51 is also rigidly attached to one side of the foot-shaped portion 41 for pivotally attaching one end of hydraulic cylinder 68 to bend arm 40. The roller carriage 43 of the bend arm assembly 17 is disposed on the opposite side of the foot-shaped portion 41 and is defined by the foot-shaped portion 41 on one side, an outer retainer plate 52 on the other side, and spacer plates 53 and 54 at each end. The outer retainer plate 52 is held in spaced relation from the foot-shaped portion 41 by the spacer plates 53 and 54.

The pinch roller 44 and bend roller 46 are mounted within the roller carriage 43 on shafts 45 and 47 respectively. The pinch roller shaft 45 is immovably retained between the foot-shaped portion 41 and the retainr plate 52 in appropriate holes, but the bend roller shaft 47 is modified to provide means to adjust the spaced relation between the bend roller 46 and the straightener roller 21 to insure that the workpiece 90 will be restraightened as it emerges from the bolt bender 10. As can be seen in FIGS. 3–8, the bend roller 46 is mounted on an enlarged section 55 of the shaft which is substantially the same length as the spacer plates 53 and 54, but this enlarged section 55 is eccentric to an axis defined by two smaller shafts 56 and 57, each of which extends from opposite ends of the enlarged eccentric section 55. One smaller shaft 56 is journaled for rotation in a bore 56 in the foot-shaped portion 41 of bend arm 40, and the other smaller shaft 57 is journaled for rotation in a bore 57 in retainer plate 52. An outer extension or head 58 of the smaller shaft 57 has a hexagonal cross-section of a dimension comparable to a standard wrench size, such as a inch, to permit manual rotation of the bend roller shaft 47 with the aid of a wrench.

Figure 8:
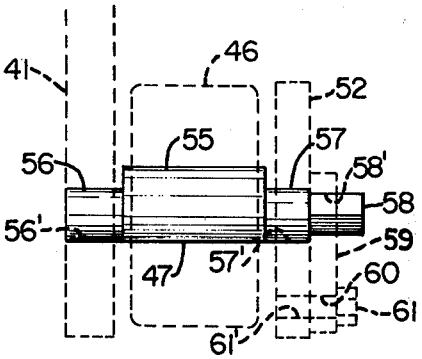
FIG. 8 is an enlarged view of the adjustable bend roller shaft with corresponding parts being shown in phantom lines.

As can be appreciated with reference to FIGS. 5 and 8 and the above description, rotation of the smaller shafts 56 and 57 about their axis will cause the enlarged eccentric section 55 of shaft 47 and the bend roller 46 to move laterally in relation to the straightener roller 21 for adjustment and spacing of the roller 46 with respect to the roller 21. A substantially triangular-shaped adjustment retention plate 59 is provided to retain the bend roller 46 in the desired adjustment position. Referring now to FIGS. 1 and 8, the adjustment retention plate 59 has a hexagonally-shaped hole 58 which is the same size and corresponds to the hexagonally-shaped outer extension 58 of shaft 57 and a slotted hole 60 which defines an arc spaced a constant radial distance from the center of the hexagonal hole 58 . The adjustment retention plate 59 is positioned on the side of the outer retainer plate 52 with the hexagonal extension 58 of the shaft 57 protruding through hole 58 . An externally threaded machine bolt 61 is inserted through the slotted hole 60 and screwed into a corresponding internally threaded hole 61 in the outer retainer plate 52 which is aligned with the slotted hole 60. As will be obvious to one skilled in the art, when the head of bolt 61 is tightened against the adjustment retention plate 59, the plate 59 is secured against any movement, and the engagement of plate 59 with the hexagonal extension 58 prevents any rotation of the shaft 47 thus prohibiting any lateral movement of the pinch roller 46 in relation to the straightener roller 21. Conversely, when lateral adjustment of bend roller 46 is desired, the bolt 61 can be manually loosened, the shaft 47 can be manually rotated with the aid of a wrench applied to the hexagonal extension 58, and such rotation is not resisted by the adjustment retention plate 59 since the bolt 61 is loosened in the slotted hole 60 allowing the plate 59 to rotate about the axis of the hexagonal extension 58.

Referring now to FIG. 7, the bend arm assembly 17 and the eccentric control assembly 18 are mounted on the drive shaft 26 in the main compartment 110 such that the bend arm 40 is in relatively closely spaced axial relation to the drive roll 16 and with the pinch roller 44 and bend roller 46 in spaced radial alignment with the drive roll 16. One eccentric wheel 62 is journaled for free rotation within the large hole 42 in bend arm 40 and within the bore of the tubular sleeve 48. As described above, the eccentric wheel 62 is attached to opposite ends of a tubular shaft 64 which is journaled for free rotation about the drive shaft 26. The lever plates 65 and 66 are also rigidly attached to the shaft 64 in spaced axial relation to each other within the tubular sleeve 48 of the bend arm assembly 17. The ram 69 of the hydraulic cylinder 68 protrudes into the tubular sleeve 48 through the side opening 49 to be pivotally attached to the lever plates 65 and 66. The side opening 49 is large enough to allow the cylinder ram 69 and lever plates 65 and 66 to travel a sufficient arc about the drive shaft 26 to complete the clamping movement of the bend arm assembly 17 as described above. The shaft 64 has a flattened portion 67 on one side to avoid interference of the cross shaft 67 with the cylinder ram 69 toward the maximum extension of the ram 69 as shown in FIGS. 3 and 6.

The follower mechanism 70 of the bend arm assembly 17 is located under the tubular sleeve 48 and is rigidly attached to the web brace 50. It comprises a shuttle pin 71, pin housing 72, and detent retainer mechanism 73. The shuttle pin 71 slides in reciprocating motion within the pin housing 72 to alternately engage and disengage the teeth 24 in the side of drive wheel 16 as determined by the program control plate 80, which will be described hereinafter. The detent mechanism 73, which yieldably retains the shuttle pin 71 in disengaged position at appropriate times during the bending operation, comprises a detent tube 74, spring 75, steel ball 76, spring retainer 77, and a groove 78 in the shuttle pin 71. With the shuttle 71 in position in the pin housing 72, the ball 76 is inserted into the detent tube 74 followed by the spring 75 and the spring retainer 77 which retains the spring 75 in the detent tube 74 with a constant pressure on the ball 76. When the shuttle pin 71 is disengaged from the teeth 24 of the drive wheel 16, the groove 78 on the pin 71 is aligned with the detent tube 74 so that the ball 76 is pushed by the spring 75 into the groove 78 thereby resisting axial movement of the shuttle pin 71 in the pin housing 72. However, when sufficient axial force is applied to the pin 71 to overcome the force of the spring, the ball 76 will be forced out of the groove 78 allowing further unresisted axial movement of the pin 71 into engagement with the drive wheel 16. The detent tube 74 can be internally threaded so that an externally threaded plug can be used as a spring retainer 77 by screwing the plug into the tube, or any other well-known means such as snap rings or soft plugs can be used for the same purpose. Further a small pin with a pointed, coned, or rounded end could be used in place of the steel ball 76. As can be appreciated from the above description and the attached drawings, when the shuttle pin 71 is shifted axially into engagement with the teeth 24 of the rotating drive wheel 16, the rotational force exerted by the drive wheel 16 will be transferred through the shuttle pin 71, pin housing 72, and web brace 50 to the bend arm 40 causing the bend arm assembly 17 to rotate with the drive wheel 16 about the drive shaft 26.

The program control plate 80 is a specially shaped steel plate which is strategically located on the main plate 37 at the opposite end of the shuttle pin 71 from the drive wheel 16 to control the engagement and disengagement of the shuttle pin 71 with the drive wheel 16 and maintain the bend arm assembly 17 at the point of maximum rotation during bending operations until the clamping force of the pinch roller 44 on the workpiece 90 is released.

Figure 10:
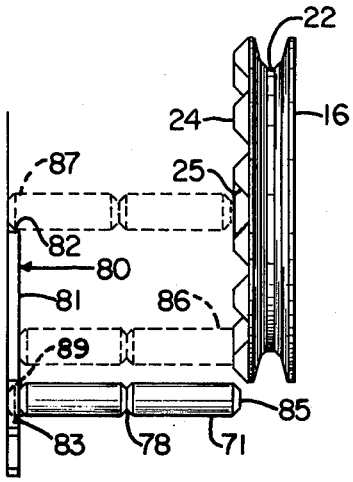
FIG. 10 is an end elevational view showing the operation of the control ramp, engagement pin, and drive wheel, the corresponding parts not being illustrated for clarity purposes.

The program control plate 80 broadly includes a glide surface 81, a retainer platform 82, and the ramp 83. In describing the operation of the program control plate 80 in conjunction with the entire operating cycle of the bolt bender 10, it will be necessary to refer to FIGS. 10 and 11 in relation successively to FIGS. 3–6. In starting position, as shown in FIG. 3, one end of the shuttle pin 71 is oriented under the teeth 24 in drive roll 16 and the opposite end of the pin 71 abuts the lower portion of the glide surface 81 as indicated at 85. As the bend arm assembly is moved upwardly by activating hydraulic cylinder 68, as described above, to clamp the workpiece 90 between the pinch roller 44 and the drive wheel 16, one end of the shuttle pin 71 is moved into engagement with the teeth 24 of the drive wheel 16, and the opposite end of pin 71, still abutting glide surface 81 to prohibit axial movement of the pin 71, moves in the position indicated at 86. The shuttle pin 71 now being in engagement with the rotating drive wheel 16 causes the bend arm assembly 17 to rotate about the drive shaft 26 to the position shown in FIG. 5 thereby bending the workpiece 90 around a portion of the circumference of drive wheel 16. Simultaneously, the opposite end of the shuttle pin 71, still abutting the glide surface 81 to prevent axial movement of the pin 71, moves upwardly to the top of the glide surface 81. At the extreme upper extremity of the program control plate 80, the end of the shuttle pin 71 passed beyond the end of the glide surface 81 allowing the axial forces imparted from the inclined surfaces 25 of the teeth 24 to the shuttle pin 71 to disengage the pin 71 from the drive wheel 16 and align the detent ball 76 with the groove 78 to prevent the shuttle pin 71 from moving back into the teeth 24. With the shuttle pin 71 disengaged from the drive wheel 16, this position shown in FIG. 5 marks the point of maximum rotation of the bend arm assembly 17, and the opposite end of the pin 71, now over the top of the glide surface 81, rests on the retainer platform 82 as indicated at 87. With the shuttle pin 71 retained on the platform 82, the bend arm assembly is maintained in its clamping position at the point of maximum rotation for the remainder of the bending operations as the drive roll 16 drives the workpiece 90 through the bolt bender 10.

Finally, when the bending operation is completed, fluid to the hydraulic cylinder 68 is reversed to release the clamping force on the workpiece 90, and the bend arm assembly 17 is extended radially outward from the drive roll 16 and drive shaft 26, as described above and as shown in FIG. 6. This outward movement of the bend arm assembly 17 results in the end of the shuttle pin 71 moving off the retainer platform 82 as indicated at 88. With the pin 71 no longer resting on the retainer platform 82, the bend arm assembly 17 is free to swing down by force of gravity to its starting position shown in FIG. 3. However, just prior to attaining the starting position as indicated at 89, the end of the shuttle pin 71 will travel over the ramp 83 onto the glide surface 81. The axial force exerted on the shuttle pin 71 is sufficient to overcome the force of the spring 75 on the detent 76 and thereby shifts the pin 71 axially into pre-engagement position under the teeth 24 of drive roll 16. Thus, the bolt bender 10 is ready for another bolt bending operation.

In use, the bolt bender 10 is mounted on a portable carrier such as the tool boom 11 of roof bolter machine. After a hole 19 is drilled in the rock overhead 14 of mine tunnel, the bolt bender 10 is moved into position and aligned with the hole 19, and the anchor boom 12 of the roof bolter machine is forced onto the mine floor 13 to secure the machine in position. A long roof bolt or workpiece is then placed substantially in horizontal position on the rollers of the bolt bender 10 and the bolt bender motor 30 is energized. The hydraulic cylinder is activated to start the bolt bender 10 through its operating cycle as described above to manipulate the workpiece 90 through approximately a 90° bend, successively restraightening it, and driving it vertically into the hole 19 in the rock of the mine overhead. When the operation is complete, the cylinder 68 is activated to release the workpiece 90 and the bolt bender 10 is moved away. The workpiece or bolt can then be anchored in the rock overhead 14 of the mine by common means such as the expandable anchor head 93 shown in the drawings.

While the bolt bender has some versatility, there is practical limit to the diameter of workpiece which can be bent in the machine due to the fixed size and configuration of the grooved peripheral surface of the drive roll since adequate frictional engagement of the drive roll with the workpiece is required to drive the workpiece through the bending operation. If necessary, however, the drive roll can be interchanged with other drive rolls with varying sized grooved peripheral surfaces. It may also be possible to devise a drive roll with a variable grooved peripheral surface similar to a variable diameter V-belt pulley.

Although the present invention has been described with a degree of particularity, it is understood that the present disclosure has been made by way of example and that changes in details of structure may be made without departing from the spirit thereof.

What is claimed is:

1. Apparatus adapted to successively bend and straighten an elongated bolt shank for insertion in a bolt hole comprising:

a drive roll rotatably mounted on a shaft and having an outer, bolt-engaging peripheral surface including drive means for rotating said drive roll;

a bend arm roller unit rotatably mounted beside said drive roll to follow the rotation of said drive roll, said bend arm roller unit including at least one pinch roller aligned with the bolt-engaging peripheral surface for movement into position to engage a bolt shank disposed for extension tangentially along the bolt-engaging peripheral surface and including a bending roll means disposed radially outwardly of said bolt-engaging peripheral surface;

bend arm drive means engageable with said bend arm roller unit to effect rotation of said bend arm roller unit in an arcuate path following the bolt-engaging peripheral surface of the drive roll whereby to effect initial bending of the leading end of the bolt shank to conform to said arcuate path;

bend arm control means operative to effect radial movement of said bend arm roller unit accomplishing in unison the functions of moving said pinch roller alternately toward and away from the bolt-engaging peripheral surface of said drive roll, moving said bending roll means in like direction parallel to the movement of said pinch roller, and alternately engaging and disengaging said bend arm drive means respectively to and from said bend arm roller unit; and straightening means at the end of the arcuate path being aligned in a tangential extension of the end of said arcuate path whereby to effect straightening of said bolt shank following its bending along said arcuate path.

2. Apparatus according to claim 1, said bend arm roller unit including an eccentric wheel which is an integral component of said bend arm control means mounted for eccentric rotation about said drive roll shaft, said eccentric wheel being rotatable independently of said drive roll shaft to simultaneously regulate both the radial distance between said pinch roller and the bolt-engaging peripheral surface of said drive roll and the engaging and disengaging of said bend arm drive means.

3. Apparatus according to claim 1, said bending roll means including a bend roller in leading relation to said pinch roller, said bend roller movable successively first radially into engagement with the bolt shank then arcuately in radially spaced relation to said arcuate path in unison with both the radial and arcuate movement of said bend arm roller unit to provide the principal active transverse force on said bolt shank to initiate bending of said bolt shank around the peripheral surface of said drive roll.

4. Apparatus according to claim 1 including a stationary guide member rigidly mounted rearward from, and independent of, said bend arm roller unit in tangential relation to said bolt-engaging peripheral surface and cooperating with said pinch roller and with said bend roller to constrain said bolt shank for bending along said arcuate path, said guide member being defined by a reaction roller journaled for rotation about a fixed axis.

5. Apparatus according to claim 1, said pinch roller and bend roller being movable into a position extending tangentially away from the bolt-engaging peripheral surface of said drive roll at the end of said arcuate path whereby to function as components of said straightening means to effect straightening of said bolt shank following its bending along said arcuate path.

6. Apparatus according to claim 1, including program control means to selectively interconnect said bend arm roller unit with said drive roll in order to follow rotation of said drive roll along the arcuate path and to selectively release said bend arm roller unit at the end of said arcuate path to permit rotation of said drive roll independently of said bend arm roller unit, said program control means being automatically activated in coordination with both the radial movement of said bend arm roller unit imparted by said bend arm control means and the arcuate movement of said bend arm roller unit imparted by said bend arm drive means.

7. Apparatus according to claim 6, said program control means including a drive plate mounted on a lateral surface of said drive roll provided with circumferentially spaced guide portions thereon, a shuttle pin slidably disposed in said bend arm roller unit and a control plate mounted at one side of said bend arm roller unit opposite to said drive plate including means thereon operative to automatically advance said shuttle pin into engagement with a guide portion of said drive plate whereby to cause said bend arm roller unit to follow rotation of said drive roll over the arcuate path and to release said shuttle pin from engagement with the guide portion on said drive plate at the end of the arcuate path.

8. Apparatus adapted to successively bend and straighten an elongated bolt shank for insertion in a bolt hole comprising:

a main wheel having an outer, bolt-engaging peripheral surface rotatable about a central axis;

a bend arm unit mounted for rotation about an axis concentric with the central axis of said main wheel, said bend arm unit including both clamping means disposed radially outward from said bolt-engaging peripheral surface for causing a bolt shank to be urged against said peripheral surface, and bending means for applying a force transverse to said bolt shank causing said bolt shank to be bent around said peripheral surface along an arcuate path with a radius approximately equal to the radius of said main wheel as said bend arm unit is rotated the length of said arcuate path about said axis;

a first stationary guide member cooperating with said main wheel and with said clamping means and said bending means by applying a force transverse to said bolt shank to constrain said bolt shank for bending along said arcuate path formed around a portion of said bolt-engaging peripheral surface of said main wheel;

straightening means disposed tangentially to said arcuate path to effect successive straightening of said bolt shank following its bending along the arcuate path, said straightening means being comprised of the combination of said bending means while said bend arm unit is positioned at its location of maximum rotation and a second stationary guide member positioned along a tangential extension of the end of said arcuate path for applying a transverse force on said bolt shank in substantially parallel spaced relation but oppositely directed to the transverse force applied to said bolt shank by said bending means;

main drive means cooperating with said main wheel for advancing the bolt shank along said arcuate path and the tangential path of said straightening means;

bend arm drive means associated with the bend arm unit to effect rotation of said bend arm unit about an axis concentric with the central axis of said main wheel; and clamping control means associated with said clamping means operative to effect radial movement of said clamping means toward and away from the bolt-engaging peripheral surface of said main wheel.

9. Apparatus according to claim 8, said clamping means comprising a pinch roller which cooperates with said clamping control means to move the bolt shank into contact and engagement with said bolt-engaging peripheral surface and to maintain it in such contact, said bending means comprising a bending roll to assist in causing the leading end of said bolt shank to be initially bent around said peripheral surface into the said arcuate path, said bending roll being movable to a position adjacent the bolt shank in tangential extension from said arcuate path on the opposite side of said bolt shank from said bolt engaging peripheral surface, said first stationary guide member defined by a reaction roller journaled for rotation about a fixed axis, and said second stationary guide member defined by a straightener roller journaled for rotation about an axis and disposed at a fixed position along the tangential extension from said arcuate path at a greater distance from said bolt-engaging peripheral surface than said bending roll and on the same side of the path followed by the bolt shank as said bolt-engaging peripheral surface.

10. Apparatus according to claim 9, said bending roll being journaled for rotation on an eccentric shaft, said eccentric shaft being journaled for eccentric rotation in said bend arm unit whereby said bending roll is adjustably movable laterally toward and away from a tengential extension of said arcuate path to vary the cooperative relationship of said bending roll with said bolt-engaging peripheral surface and said second stationary guide member for effecting either partial or complete straightening of said bolt shank.

11. Apparatus according to claim 8, said main drive means comprising an externally powered prime mover drivingly connected to said main wheel to impart rotational movement to said main wheel about its axis whereby the bolt shank which is engaged with the bolt-engaging peripheral surface of said main wheel is caused to be bent along said arcuate path and through successive tangential straightening, and said bend arm drive means including teeth formed on the lateral side of said main wheel adjacent said bend arm unit, a shuttle pin housing attached to said bend arm unit, and a shuttle pin disposed within said housing, said shuttle pin being axially movable into engagement with said teeth whereby the rotational movement of said main wheel about its axis is imparted to said bend arm unit.

12. Apparatus according to claim 8, said clamping control means comprising a control wheel being journaled for eccentric rotation about said central axis of rotation of said main wheel, said control wheel also being journaled for rotation within said bend arm unit, and control wheel rotation means to impart eccentric rotational movement to said control wheel whereby to cause radial movement of said bend arm unit with respect to said main wheel.

13. Apparatus according to claim 12, said control wheel rotation means comprising a radial extension of said control wheel and an axially expandable and contractable control wheel drive means, one end of said control wheel drive means being pivotally connected to said radial extension and the opposite end being pivotally attached to said bend arm unit, whereby contraction of said control wheel drive means causes rotation of said control wheel in one direction to move said bend arm unit radially toward said main wheel and expansion of said control wheel drive means causes rotation of said control wheel in the opposite direction to move said bend arm unit radially away from said main wheel.

14. Apparatus adapted to successively bend and straighten an elongated bolt shank for insertion in a bolt hole comprising:

a drive roll rotatable about a central axis and mounted on a central drive shaft which forms said central axis including drive means associated with said drive wheel for rotating said drive roll, and said drive roll having an outer, bolt-engaging peripheral surface;

a bend arm unit mounted for rotation about an axis defined by said central drive shaft including at least one pinch roller journaled for rotation about a shaft rigidly attached to said bend arm unit and aligned radially outward from said bolt-engaging peripheral surface, a pinch roller control means associated with the bend arm unit operative to effect radial movement of said bend arm unit with respect to said central axis whereby said pinch roller causes the bolt shank to be moved into engaging contact with said bolt-engaging peripheral surface and maintains the bolt shank in such contact, and a bending roll journaled for rotation about a shaft adjustably mounted on said bend arm unit and aligned radially outward from both said drive roll and said pinch roller such that when the pinch roller is maintaining the bolt shank in contacting engagement with the bolt-engaging peripheral surface the bending roll is also in contact with the bolt shank on a line tangential to said bolt-engaging peripheral surface; and a bend arm drive including circumferentially-spaced guide portions defined in the side of said drive roll adjacent said bend arm unit, a shuttle pin housing in said bend arm unit adjacent said guide portions, and a shuttle pin slidably disposed in said shuttle pin housing, said shuttle pin being slidable toward said drive roll into engagement with said adjacent guide portions whereby rotational movement of said drive roll is imparted to said bend arm unit to drive said pinch roller and said bending roll in an arcuate path about said central axis to cause the bolt shank to be bent into an arcuate path around said bolt-engaging peripheral surface, and alternately said shuttle pin being slidable away from said drive roll to disengage from said guide portions whereby said drive roll is permitted to continue to rotate free of said bend arm unit driving said bolt shank axially through said arcuate path while said pinch roller remains in stationary contact with the bolt shank at the end of the arcuate path and said bending roll remains in stationary contact with the bolt shank a tangentially-spaced distance beyond the end of said arcuate path.

15. Apparatus according to claim 14, said pinch roller control means including an eccentric wheel journaled for free rotation within said bend arm unit between said bend arm unit and said central axis, said eccentric wheel also being journaled for free eccentric rotation about an axis concentric with said central axis, and including eccentric rotation means to eccentrically rotate said eccentric wheel about said central axis whereby radial movement with respect to said central axis is imparted to said bend arm unit and pinch roller.

16. Apparatus according to claim 14, the engagement and disengagement of said shuttle pin with said guide portions defined on the side of said drive roll being controlled by a program control plate being disposed in stationary position on the opposite side of said bend arm unit from said drive roll and in constant contact with the end of said shuttle pin opposite said engaging end, said program control plate being shaped such that said shuttle pin is caused to slide into engagement with said guide portions whereby said bend arm unit causes the bolt shank to be bent into said arcuate path around said bolt-engaging peripheral surface, said program control plate also being shaped such that said shuttle pin is allowed to slide away from said guide portions disengaging therefrom whereby said bend arm unit ceases its rotational movement about said central axis, said program control plate also being shaped such that a force is maintained on said shuttle pin transverse to its axis whereby said bend arm unit is retained in position at its place of maximum rotation with said pinch roller located at the end of said arcuate path, and said control plate also being shaped such that said transverse force on said shuttle pin is released when said pinch roller control means causes said bend arm unit to move radially outward from said central axis whereby said bend arm unit is permitted to return to starting position at the beginning of said arcuate path.

17. Apparatus according to claim 15, said eccentric rotation means comprising a bracket extending radially from said eccentric wheel and a hydraulic cylinder with an axially extendable and retractable ram, the ram of said cylinder being pivotally attached to said bracket and the opposite end of said cylinder being pivotally attached to said bend arm unit, whereby extension of said ram imparts rotational movement to said eccentric wheel in one direction causing said bend arm unit to move radially away from said central axis and retraction of said ram imparts rotational movement to said eccentric wheel in the opposite direction causing said bend arm unit to move radially toward said central axis.

* * * * *

UNITED STATES PATENT OFFICE

CERTIFICATE OF CORRECTION

Patent No. 4,003,233 Dated January 18, 1977

Inventor(s) Ronald R. Stange

It is certified that error appears in the above-identified patent and that said Letters Patent are hereby corrected as shown below:

Column 1, line 19, after "accordingly" add -- , --.

Column 3, line 30, cancel "drill" and substitute -- drive --.
line 64, cancel "rollrs" and substitute -- rollers --.

Column 4, line 59, cancel "cases" and substitute -- ceases --.

Column 6, line 4, cancel "retainr" and substitute -- retainer --
line 19, cancel "57" and substitute -- 57' --.
line 17, cancel "56" and substitute -- 56' --.
line 22, after "a" (2nd occurrence) add -- 5/8 --.
line 36, cancel "58" and substitute -- 58' --.
line 40, cancel "58" and substitute -- 58' --.
line 43, cancel "58" and substitute -- 58' --.
line 45, cancel "61" and substitute -- 61' --.

Column 9, line 2, after "of" add -- a --.

Claim 10, Column 12, lines 8 and 9, cancel "tengential" and substitute -- tangential --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*